US006269603B1

(12) United States Patent
Ross

(10) Patent No.: US 6,269,603 B1
(45) Date of Patent: Aug. 7, 2001

(54) ROOFING OR SHEATHING

(75) Inventor: James Cameron Ross, Auckland (NZ)

(73) Assignee: Metro Shingles (Intl) Limited, Auckland (NZ)

( * ) Notice: Subject to any disclaimer, the term of this patent is extended or adjusted under 35 U.S.C. 154(b) by 0 days.

(21) Appl. No.: 09/529,059

(22) PCT Filed: Feb. 9, 1999

(86) PCT No.: PCT/NZ99/00018

§ 371 Date: Apr. 7, 2000

§ 102(e) Date: Apr. 7, 2000

(87) PCT Pub. No.: WO99/41471

PCT Pub. Date: Aug. 19, 1999

(51) Int. Cl.[7] ..... E04D 1/00

(52) U.S. Cl. ..... 52/520; 52/518; 52/521; 52/544; 52/529

(58) Field of Search ..... 52/538, 529, 545, 52/546, 518, 519, 522, 521

(56) References Cited

U.S. PATENT DOCUMENTS 4,266,385 5/1981 Oehlert .
4,334,396 * 6/1982 Hagopian ..... 52/522
4,819,398 * 4/1989 Dameron ..... 52/529
5,074,093 12/1991 Meadows .
5,150,555 * 9/1992 Wood ..... 52/544
5,305,570 4/1994 Rodriguez et al. .
5,465,486 * 11/1995 King ..... 29/897.32
5,651,227 * 7/1997 Anderson ..... 52/520
5,657,603 8/1997 Goodhart et al. .
6,000,185 * 10/1999 Beck ..... 52/520
6,170,215 * 1/2001 Nasi ..... 52/521
6,173,546 * 1/2001 Schafer ..... 52/522

* cited by examiner

*Primary Examiner*—Robert Canfield
*Assistant Examiner*—Chi Nguyen
(74) *Attorney, Agent, or Firm*—Wenderoth, Lind & Ponack, L.L.P.

(57) ABSTRACT

An exterior sheathing element includes a first edge portion having a channel, and includes a second edge portion opposite the first edge portion and including a channel. At least a part of the second edge portion has a mounting tab projecting clear of the second edge portion in a substantially co-planar relationship with respect to the main body of the sheathing element.

16 Claims, 2 Drawing Sheets

FIG. 3
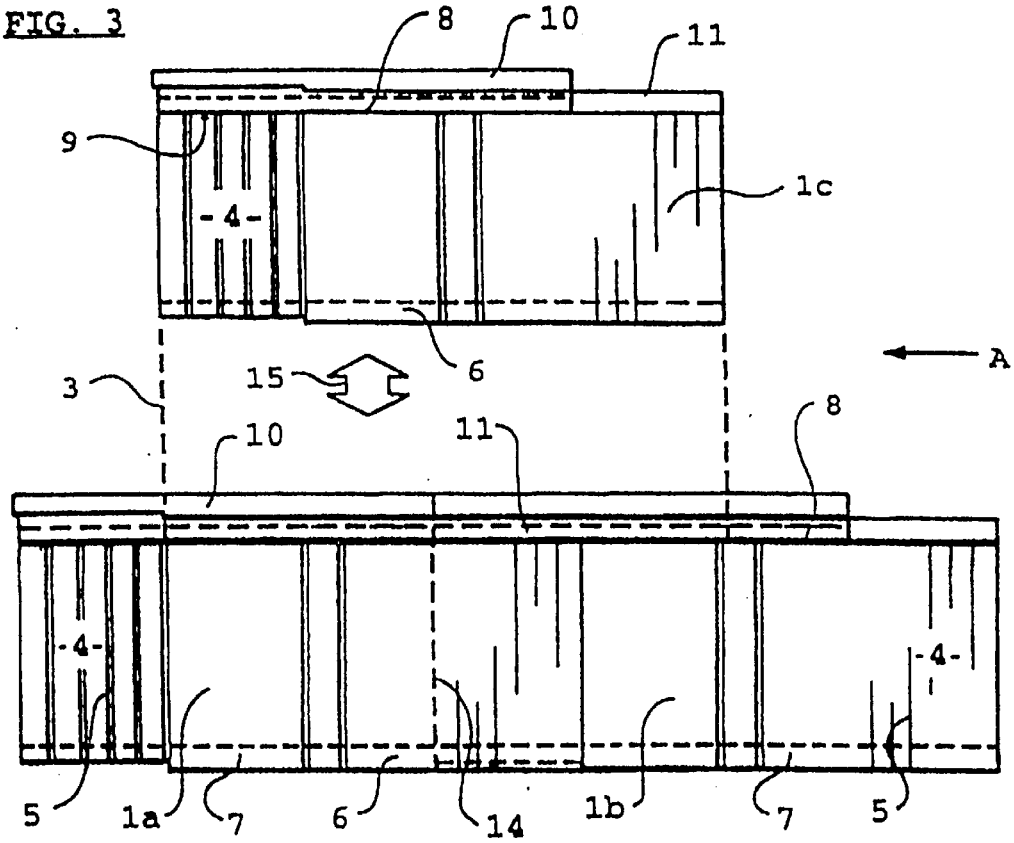
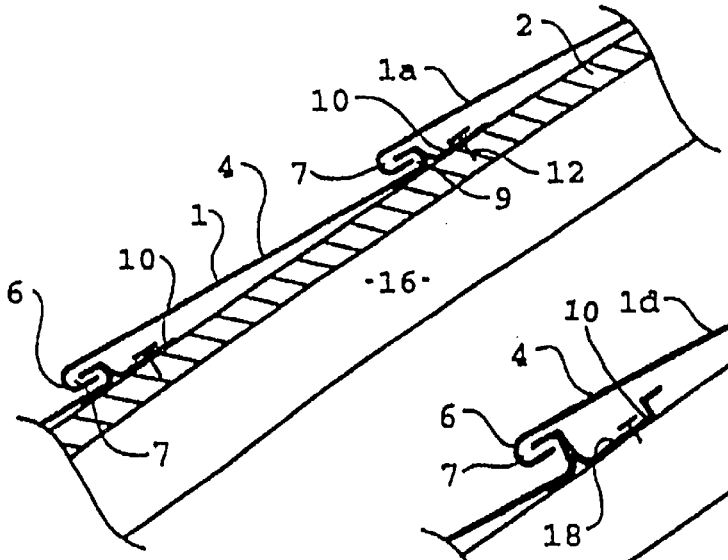
FIG. 4
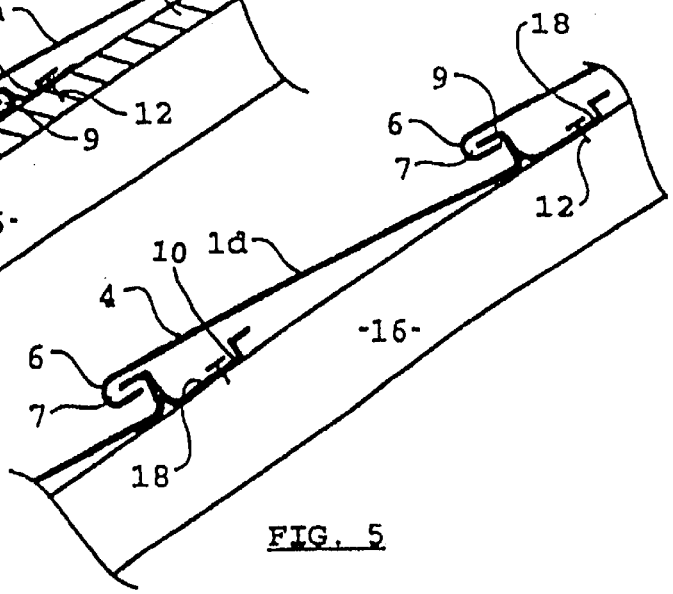
FIG. 5

ROOFING OR SHEATHING

TECHNICAL FIELD OF THE INVENTION

This invention relates to an exterior sheathing element and a method of applying exterior sheathing to a structure. More particularly the invention relates to a sheet metal sheathing element useful for roofing.

BACKGROUND ART OF THE INVENTION

A variety of exterior sheathing elements including those formed from sheet metal are known. Traditionally with exterior sheathing, particularly roofing, the word "tile" is used to indicate a single tile such as a concrete tile. With the development of sheet metal sheathing it has become well established to manufacture elements that visually replicate the designs of such traditional tiles. Because these sheet metal tiles are substantially lighter than their concrete counterparts they are normally manufactured as multiple units, that is, as to replicate say three or four traditional tiles. This capability is one of the advantages these tile have over the traditional "single" tile. This invention is primarily concerned with a multiple sheet metal tile and herein the term "tile" is used accordingly. However, the nature of the invention does lend itself for manufacture and use as a single tile element and the term is to be considered as being applicable to either form of tile.

A first object of this invention is to provide a sheet metal sheathing element particularly useful as a roofing tile that can be manufactured utilising thinner sheet metal than typically used with sheet metal tiles. A second object is to provide a sheet metal tile that replicates a traditional wooden shingle "tile" particularly in a multiple configuration thereof as discussed above relative to concrete tiles. A further object of this invention is to provide such a sheathing element adapted for individual fixing to a supporting structure and subsequent conjoining and fixing of further tiles both laterally and longitudinally of the first tile. The steps can be repeated to cover a desired area of a supporting structure and thus a further object is to provide a method of affixing sheathing tile to a structure. Yet a further object is to provide the public with a further choice in sheathing elements in particular a sheathing element suitable for mounting by relatively unskilled people.

DISCLOSURE OF THE INVENTION

According to a first aspect of this invention there is provided an exterior sheathing element having a first edge portion forming a channel on what, in situ, will be an innerface of the element, and having a second and opposite edge portion forming a channel on what, in situ, will be an outerface of the element, with a part of that second edge portion, being a part set-back from at least one side of the tile, having a mounting tab projecting clear of the second edge portion in a substantially co-planar relationship to a main body of the element, the structure enabling a mounting tab free part at one side of a first sheathing element to be overlapped with a side of a second element with their corresponding folded edge portions engaged, and a first folded edge portion of a third sheathing element to be engaged over and about the second folded edge portion of at least one of the first and second sheathing elements.

According to a second aspect of this invention there is provided a sheet metal exterior sheathing element configured to replicate at least one wooden shingle and comprising a substantially planar body save for strengthening indentations including, adjacent one side, a series of longitudinally extending ribs, the ribs being on that side of a tile intended, in use, to be disposed on the underside when overlapped with a side of a second element to also act as weathering indentations, and having a first edge portion turned back on itself to form a channel on what, in situ, will be an innerface of the element, and having a second and opposite edge portion also turned back on itself to form a channel on what, in situ, will be an outerface of the element with a part of that second edge portion set-back from at least one side thereof having a return fold to extend back on itself and project clear of and substantially co-planar to the body of the element to form a mounting tab, the structure enabling a first and second sheathing element disposed with their sides overlapping and their corresponding folded edge portions engaged, the first folded edge of the lowermost tile being located within the channel of the first folded edge of the uppermost element and the mounting tab free part of the second folded edge of the uppermost element being located within the channel of the lowermost element and a first folded edge portion of a third tile to be engaged over and about the second folded edge portion of at least one of the first and second tiles.

According to a third aspect of this invention there is provided an exterior sheathing element having a substantially planar body and having a first edge portion folded over to overlay, in adjacent spaced relationship to thereby form a first transversely disposed channel, what in situ will be a lower section of an innerface of the element, and having a second edge portion opposite the first edge portion, folded over to overlay, in adjacent spaced relationship to thereby form a second transversely disposed channel, what in situ will be an upper section of an outerface of the element, at least a part of the second edge portion being further folded back on and over itself to form a mounting tab projecting clear of the second edge portion in a substantially co-planar relationship to the plane of the body of the element, the structure of the element enabling a first side portion of a first sheathing element to be overlapped with a second and opposite side portion of a second element without engagement except for the overlapping sections of the first and second folded edge portions, engagement of those sections being by the side section of the first folded edge portion of the underlay element being located in the groove formed by the corresponding section of the overlay element, and the side section of the second folded section of the overlay element being located in the groove formed by the corresponding section of the underlay element, and a first folded edge portion of a third sheathing element to be engaged over the overlapping sections and adjacent sections of the second folded edge portions of the first and second sheathing elements with those second folded edge sections being located in the groove formed by the first folded edge portion of the third element.

According to a fourth aspect of this invention there is provided a method of exterior sheathing a structure with a plurality of sheathing elements as described in any one of the three immediately preceding paragraphs comprising substantially of repeating the steps of positioning a first sheathing element on a sheathing element support of the structure, positioning a second sheathing element with a side section thereof in an overlapping relationship with a section side of the first element and in so doing ensuring their corresponding folded edge portions engage one within the other by the side section of the first folded edge portion of the underlay element being located in the groove formed by the corresponding section of the overlay element, and the side section of the second folded section of the overlay element being located in the groove formed by the corresponding section of the underlay element, and positioning a first folded edge portion of a third sheathing element in engagement over the overlapping sections and adjacent sections of the second folded edge portions of the first and second sheathing elements with those second folded edge sections being located in the groove formed by the first folded edge portion of the third element, and throughout utilising mounting means with the mounting tabs to affix the sheathing elements to the support.

BRIEF DESCRIPTION OF DRAWINGS

FIG. 3 depicts a third sheathing element adjacent the two laterally overlapped elements depicted in FIG. 2, the third element being presented to be joined to the first two elements a position depicted schematically by broken-line 3, and FIG. 4 is a partly schematic side view essentially in the direction of arrow A on FIG. 3 and with the elements engaged with one another and mounted in situ onto a support extending adjacently therebeneath for substantially the complete span of the sheathing and FIG. 5 is a similar view to FIG. 4 depicting a variation of the sheathing element mounted to support rafters disposed in a spaced apart manner beneath the sheathing.

BEST MODE OF CARRYING OUT OF THE INVENTION

Figure 1:
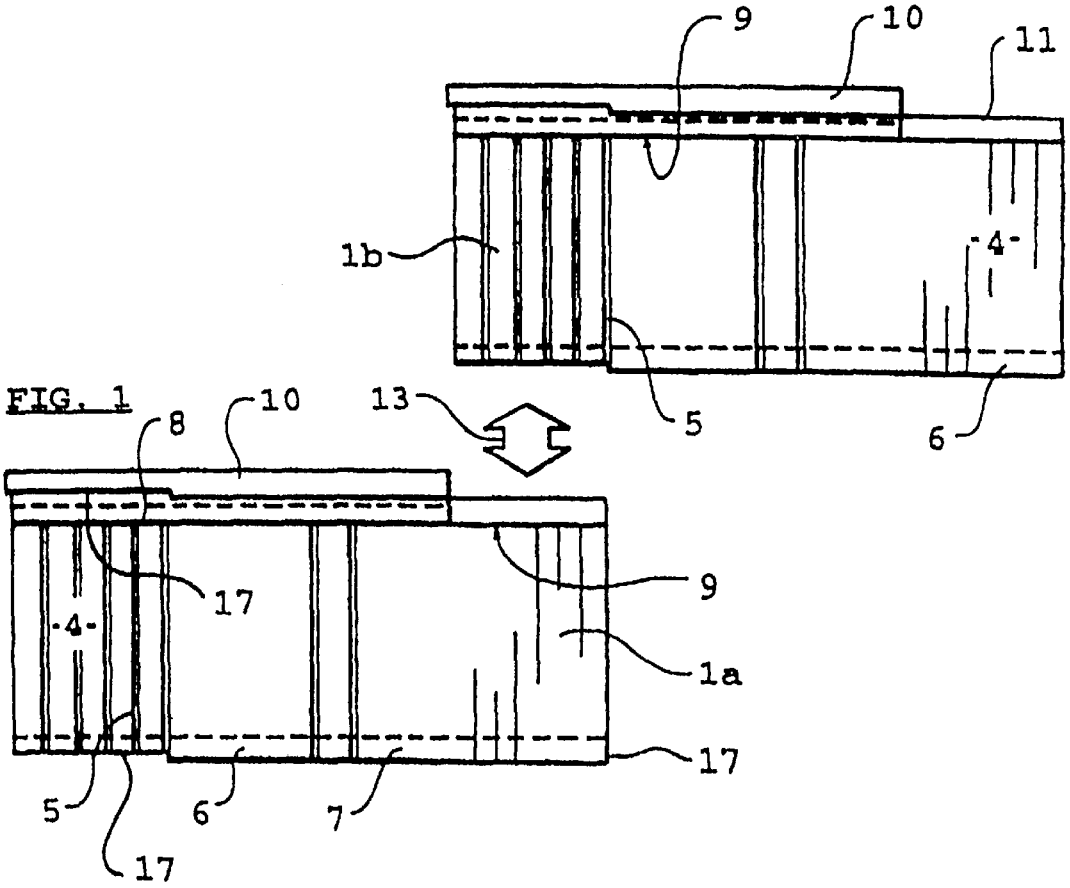
FIG. 1 is an upperface or obverse view of two sheathing elements being presented to one another in readiness for being laterally overlapped and engaged with one another as depicted in FIG. 2.

A sheathing element 1 is preferably manufactured from sheet metal in known manner such as by pressing, roll forming and/or folding. Preferably element 1 is designed as a multiple tile as discussed above and in particular to replicate a plurality of wooden shingles arranged in a side overlapping side relationship as in situ. While the tile of this invention can be manufacture from sheet metal as typically used for sheet metal sheathing tiles; the design lends itself suitable for manufacture using thinner sheet metal. This in turn enables the tile to economically replicate wooden shingles. Preferably sheet metal in the region of 0.27 mm gauge is used, in situ, this necessitating a support extending completely therebeneath. Typically such a support is, as depicted in FIG. 4, plywood or similar sheets 2 being mounted on rafters 16 or similar elements to completely cover an area. Because of their lightweight, their design and their preferred utilisation with such a support the tile of this invention is suitable for mounting by relatively unskilled people.

Preferably sheathing element 1 is pressed into a thin or substantially single plane configuration having on overall thickness, including inter-engaging channels 7 and 9 as described below, similar to that of a typical wooden shingle. Indentations indicated by various longitudinally extending lines on the drawings are preferably provided to strengthen the tile 1 and provide the desired visual wooden shingle replication. These indentations are not pronounced and in the preferred form the tile 1 has the exterior face thereof coated, in known manner, with stone chips or similar (not shown for the sake of clarity) to enhance this replication.

Figure 2:
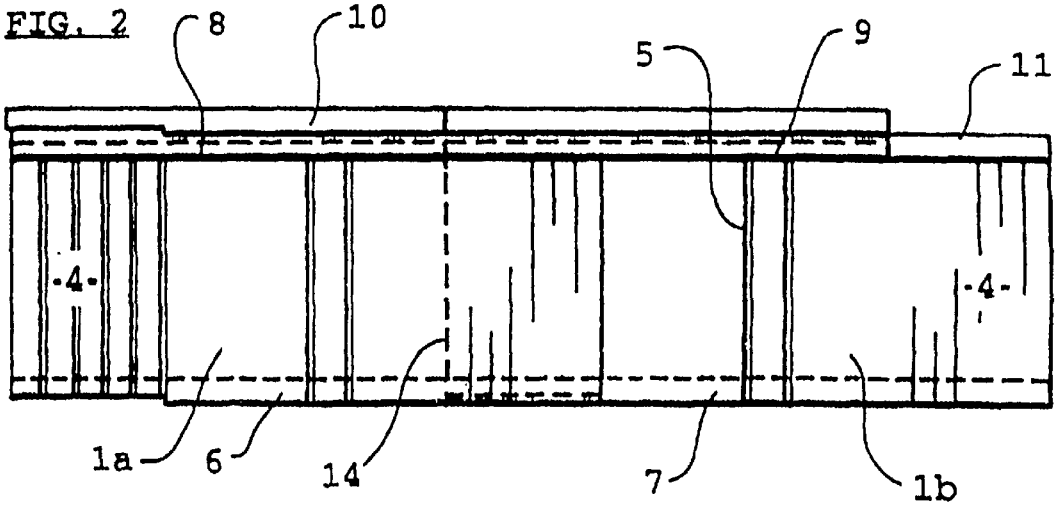

The indentations include weather ingress inhibiting ribs 5, preferably longitudinally extending in a corrugated manner and preferably being more pronounced than most of the remainder of the indentations. The ribs 5 are disposed along at least one side zone 4 of the tile 1, being that side that in use is disposed on the underside when overlapped (as depicted by FIGS. 1 and 2). with another tile 1. In the drawings both sides of a tile 1 are shown with ribs 4 but they are not necessary on that side of a tile 1 that will be uppermost in situ.

A first edge portion 6 is formed back on itself such as by folding to form a channel 7 on what, in situ, will be an innerface of the tile 1. On a second and longitudinally opposite edge portion 8 a further channel 9 is formed on what, in situ, will be an outerface of the tile 1. (While the tile 1 is preferably wider than it is long the terms "side" and "longitudinal" are used in the manner chosen to assist clarity.) Channel 9 is also preferably formed by folding and a mounting tab 10 is also formed projecting from that outer edge portion 8.

Mounting tab 10 extends along the edge portion 8 but preferably terminates short of one side of the tile 1 to leave a mounting tab free section 11. The tab free section 11 is preferably disposed at the side of the tile opposite the ribs 5 or in other words that side of a tile 1 that will be uppermost when in a side overlapping relationship with another tile. It will be understood by those skilled in the art and the following description that mounting tab 10 may also terminate short of the other side of the element and need not be continuous.

Mounting tab 10 is preferably formed by providing a return fold on the mounting tab forming part of edge 8, the mounting tab 10 extending back about channel 9 and then outwardly substantially co-planar with the body of the tile 1. The side of edge portion 8 distal of mounting tab free part 11 and the associated engaging section of edge portion 6 may be stepped, as indicated at 17 on tile 1*a* in FIG. 1, to assist the side overlap engagement, and continuity of line, of one tile with another. For similar reasons, at the area 17, channel 9 may be marginally "opened" and at the tab free part 11 marginally "closed".

The construction and arrangement of the tile 1 enables a plurality of tiles 1 to be laterally overlapped with one another as depicted in FIG. 2. Referring in particular to FIG. 1, the overlap is undertaken by presenting a first tile 1*a* to a second tile 1*b*. This is indicated by double headed arrow 13, the overlap providing their corresponding edge portions 7 and 8 are engaged within one another. More particularly, the edge portion 6 of tile 1*b* locates within channel 7 of tile 1*a* and the tab free section 11 of edge portion 8 of tile 1*a* locates in channel 9 of tile 1*b*.

Referring in particular to FIG. 3 a third tile 1*c* can then be presented; as indicated by the double headed arrow 15, to tiles 1*a* and/or 1*b*. Preferably the presentation is as to engage the folded edge 7 of tile 1*c* over and about the overlapping folded edges 8 of the tiles 1*a* and 1*b* and as to extent to either side of that overlap. This relationship of three such tiles 1 enhances the weathering capabilities of the junction between the tiles 1. For clarity, this engagement is depicted in side view schematically in FIGS. 4 and 5, the engagement being in the nature of a close nesting or clipping together.

A preferred method of in situ mounting is to connect tiles 1 in the sequence described above. In so doing the tiles are rested on backing support sheet 2 and fixed thereto such as by step 12 through the mounting tabs 10 into the sheet 2. These steps are substantially repeated to cover the whole of a required area. In so doing the mounting tabs 10 are hidden from view and a continuous sheathing finish achieved.

Referring in particular to FIG. 5 a variation of the sheathing element 1 is depicted. This sheathing element 1*d* is preferably manufactured from thicker sheet metal in the region of 0.5 mm gauge sheet metal. Mounting tab 10 incorporates a laterally extending channel that can be used as a batten to affix the sheathing elements 1*d* directly to spaced apart rafters 16.

What is claimed is:

1. An exterior sheathing element comprising:

a main body having lateral sides;

a first edge portion on said main body between said lateral sides, said first edge portion including an innerface channel;

a second edge portion on said main body between said lateral sides and opposite said first edge portion, said second edge portion including an outerface channel; and a mounting tab projecting from said second edge portion so as to be substantially co-planar with respect to said main body; and an overlapping section of said second edge portion located near at least one of said lateral sides of said main body, said overlapping section being free of said mounting tab and being adapted to be overlapped with a side of an adjoining second sheathing element so that said first edge portion and said second edge portion of the sheathing element engage the first edge portion and the second edge portion of the adjoining second sheathing element, respectively; and wherein a first edge portion of an adjoining third sheathing element can engage both said second edge portion of he sheathing element and the second edge portion of the adjoining second sheathing element.

2. The sheathing element of claim 1, wherein said lateral sides of said main body comprise an upper side and a lower side, wherein said upper side and said lower side are defined with respect to a position after the sheathing element has been overlapped with the adjoining second sheathing element, said overlapping section being located at said upper side of said main body.

3. The sheathing element of claim 2, wherein said mounting tab includes a support batten extending in a longitudinal direction with respect to said main body, said support batten being formed as a channel.

4. The sheathing element of claim 1, wherein said mounting tab includes a support batten extending in a longitudinal direction with respect to said main body, said support batten being formed as a channel.

5. A method of sheathing an exterior of a structure using a plurality of the sheathing elements of claim 1, said method comprising:

positioning a first sheathing element on a support structure;

overlaying a second sheathing element onto and adjacent to the first sheathing element so that a side of the second sheathing element overlaps an adjoining side of the first sheathing element;

engaging the first edge portion and the second edge portion of the second sheathing element with the first edge portion and the second edge portion of the first sheathing element, respectively, by inserting a side section of the first edge portion of the first sheathing element into the innerface channel of the first edge portion of the second sheathing element, and by inserting a side section of the second edge portion of the second sheathing element into the outerface channel of the second edge portion of the first sheathing element;

positioning a third sheathing element adjacent to the first sheathing element and the second sheathing element so that the first edge portion of the third sheathing element is engaged over an overlapping section of the first sheathing element and the second sheathing element, whereat the second end portion of the first sheathing element engages the second end portion of the second sheathing element, by inserting the overlapping section into the innerface channel of the first edge portion of the third sheathing element;

fixing the first sheathing element, the second sheathing element, and the third sheathing element to the support structure by using a mounting device to attach the mounting tab of each sheathing element to the support structure; and repeating said positioning of the first sheathing element, said overlaying of the second sheathing element, said engaging of the first edge portion and the second edge portion of the second sheathing element with the first edge portion and the second edge portion of the first sheathing element, said positioning of the third sheathing element, and said fixing of the first sheathing element as necessary so as to sheath the support structure.

6. An exterior sheathing element comprising:

a substantially planar main body having lateral sides and having ribs extending substantially parallel to said lateral sides, said ribs being located adjacent to one of said lateral sides of said main body;

a first edge portion on said main body between said lateral sides, said first edge portion including an innerface channel;

a second edge portion on said main body between said lateral sides and opposite said first edge portion, said second edge portion including an outerface channel; and a mounting tab projecting from said second edge portion so as to be substantially co-planar with respect to said main body, said mounting tab being formed by folding an end of said second edge portion back across said outerface channel so as to project from said second edge portion; and an overlapping section of said second edge portion located near at least one of said lateral sides of said main body, said overlapping section being free of said mounting tab and being adapted to be overlapped with a side of an adjoining second sheathing element so that said fist edge portion of the sheathing element is located within the innerface channel of the first edge portion of the adjoining second sheathing element, and so that the overlapping section of the second edge portion of the adjoining second sheathing clement is located within said outerface channel of the sheathing element; and wherein a first edge portion of an adjoining third sheathing element can engage both said second edge portion of the sheathing clement and the second edge portion of the adjoining second sheathing element.

7. The sheathing element of claim 6, wherein said mounting tab includes a support batten extending in a longitudinal direction with respect to said main body, said support batten being formed as a channel.

8. A method of sheathing an exterior of a structure using a plurality of the sheathing elements of claim 6, said method comprising:

positioning a first sheathing element on a support structure;

overlaying a second sheathing element onto and adjacent to the first sheathing element so that a side of the second sheathing element overlaps an adjoining side of the first sheathing element;

engaging the first edge portion and the second edge portion of the second sheathing element with the first edge portion and the second edge portion of the first sheathing element, respectively, by inserting a side section of the first edge portion of the first sheathing element into the innerface channel of the first edge portion of the second sheathing element, and by inserting a side section of the second edge portion of the second sheathing element into the outerface channel of the second edge portion of the first sheathing element;

positioning a third sheathing element adjacent to the first sheathing element and the second sheathing element so that the first edge portion of the third sheathing element is engaged over an overlapping section of the first sheathing element and the second sheathing element, whereat the second end portion of the first sheathing element engages the second end portion of the second sheathing element, by inserting the overlapping section into the innerface channel of the first edge portion of the third sheathing element;

fixing the first sheathing element, the second sheathing element, and the third sheathing element to the support structure by using a mounting device to attach the mounting tab of each sheathing element to the support structure; and repeating said positioning of the first sheathing element, said overlaying of the second sheathing element, said engaging of the first edge portion and the second edge portion of the second sheathing element with the first edge portion and the second edge portion of the first sheathing element, said positioning of the third sheathing element, and said fixing of the first sheathing element as necessary so as to sheath the support structure.

9. An exterior sheathing clement comprising:

a substantially planar main body having lateral sides;

a first edge portion on said main body between said lateral sides, said first edge portion including a longitudinal innerface channel;

a second edge portion on said main body between said lateral sides and opposite said first edge portion, said second edge portion including a longitudinal outerface channel; and a mounting tab projecting from said second edge portion so as to be substantially co-planar with respect to said main body, said mounting tab projecting from only a section of said second edge portion so as to form an overlapping section of said second edge portion located near one of said lateral sides of said main body, wherein said overlapping section is free of said mounting tab;

wherein one of said lateral sides of the sheathing clement is adapted to be overlapped with a side of an adjoining second sheathing element so that a side portion of said first edge portion of the sheathing clement is located within the innerface channel of the adjoining second sheathing element, and so that a side portion of the second edge portion of the adjoining second edge portion is located within said outerface channel of the sheathing element; and wherein a first edge portion of an adjoining third sheathing element can engage both said second edge portion of the sheathing clement and the second edge portion of the adjoining second sheathing element.

10. The sheathing element of claim 9, wherein said mounting tab includes a support batten extending in a longitudinal direction with respect to said main body, said support batten being formed as a channel.

11. The sheathing element of claim 9, wherein said main body comprises sheet metal formed so as to have a wood grain outer texture, said main body having ribs extending substantially parallel to said lateral sides, said ribs being located adjacent to one of said lateral sides of said main body opposite said one of said lateral sides whereat said overlapping section is formed.

12. The sheathing element of claim 11, wherein said mounting tab includes a support batten extending in a longitudinal direction with respect to said main body, said support batten being formed as a channel.

13. A method of sheathing an exterior of a structure using a plurality of the sheathing elements of claim 11, said method comprising:

positioning a first sheathing element on a support structure;

overlaying a second sheathing element onto and adjacent to the first sheathing element so that a side of the second sheathing element overlaps an adjoining side of the first sheathing element;

engaging the first edge portion and the second edge portion of the second sheathing element with the first edge portion and the second edge portion of the first sheathing element, respectively, by inserting a side section of the first edge portion of the first sheathing element into the innerface channel of the first edge portion of the second sheathing element, and by inserting a side section of the second edge portion of the second sheathing element into the outerface channel of the second edge portion of the first sheathing element;

positioning a third sheathing element adjacent to the first sheathing element and the second sheathing element so that the first edge portion of the third sheathing element is engaged over an overlapping section of the first sheathing element and the second sheathing element, whereat the second end portion of the first sheathing element engages the second end portion of the second sheathing element, by inserting the overlapping section into the innerface channel of the first edge portion of the third sheathing element;

fixing the first sheathing element, the second sheathing element, and the third sheathing element to the support structure by using a mounting device to attach the mounting tab of each sheathing element to the support structure; and repeating said positioning of the first sheathing element, said overlaying of the second sheathing element, said engaging of the first edge portion and the second edge portion of the second sheathing element with the first edge portion and the second edge portion of the first sheathing element, said positioning of the third sheathing element, and said fixing of the first sheathing element as necessary so as to sheath the support structure.

14. The method of claim 13, wherein said overlaying of the second sheathing element comprises positioning the overlapping section of the second sheathing element over a side portion of the first sheathing element.

15. The sheathing element of claim 9, wherein said mounting tab includes a support batten extending in a longitudinal direction with respect to said main body, said support batten being formed as a channel.

16. A method of sheathing an exterior of a structure using a plurality of the sheathing elements of claim 9, said method comprising:

positioning a first sheathing element on a support structure;

overlaying a second sheathing element onto and adjacent to the first sheathing element so that a side of the second sheathing element overlaps an adjoining side of the first sheathing element;

engaging the first edge portion and the second edge portion of the second sheathing element with the first edge portion and the second edge portion of the first sheathing element, respectively, by inserting a side section of the first edge portion of the first sheathing element into the innerface channel of the first edge portion of the second sheathing element, and by inserting a side section of the second edge portion of the second sheathing element into the outerface channel of the second edge portion of the first sheathing element;

positioning a third sheathing element adjacent to the first sheathing element and the second sheathing element so that the first edge portion of the third sheathing element is engaged over an overlapping section of the first sheathing element and the second sheathing element, whereat the second end portion of the first sheathing element engages the second end portion of the second sheathing element, by inserting the overlapping section into the innerface channel of the first edge portion of the third sheathing element;

fixing the first sheathing element, the second sheathing element, and the third sheathing element to the support structure by using a mounting device to attach the mounting tab of each sheathing element to the support structure; and repeating said positioning of the first sheathing element, said overlaying of the second sheathing element, said engaging of the first edge portion and the second edge portion of the second sheathing element with the first edge portion and the second edge portion of the first sheathing element, said positioning of the third sheathing element, and said fixing of the first sheathing element as necessary so as to sheath the support structure.

* * * * *